US006719008B1

(12) United States Patent
LeDevehat

(10) Patent No.: US 6,719,008 B1
(45) Date of Patent: Apr. 13, 2004

(54) OFFSHORE LOADING SYSTEM BY SUSPENDED PIPING

(75) Inventor: Renaud LeDevehat, Thorigny sur Oreuse (FR)

(73) Assignee: FMC Technologies, S.A., Sens (FR)

( * ) Notice: Subject to any disclaimer, the term of this patent is extended or adjusted under 35 U.S.C. 154(b) by 160 days.

(21) Appl. No.: 10/030,858

(22) PCT Filed: Jul. 7, 2000

(86) PCT No.: PCT/FR00/01978

§ 371 (c)(1),
(2), (4) Date: May 8, 2002

(87) PCT Pub. No.: WO01/04041

PCT Pub. Date: Jan. 18, 2001

(30) Foreign Application Priority Data

Jul. 13, 1999 (FR) ..... 99 09092

(51) Int. Cl.[7] ..... B67D 5/70; B63B 27/24
(52) U.S. Cl. ..... 137/615; 417/387
(58) Field of Search ..... 137/615, 899; 417/387, 388

(56) References Cited

U.S. PATENT DOCUMENTS 4,220,177 A * 9/1980 Gill ..... 137/615
4,299,261 A * 11/1981 Talafuse ..... 141/387
6,343,620 B1 * 2/2002 LeDevehat et al. ..... 137/615
6,416,086 B1 * 7/2002 Pelletier et al. ..... 141/387 X

* cited by examiner

*Primary Examiner*—Kevin Lee
(74) *Attorney, Agent, or Firm*—Henry C. Query, Jr.

(57) ABSTRACT

The invention concerns an assembly for transferring fluid (13) between a first site and a second site, comprising: a winch (40) for the first site (10) whereon is wound a suspension cable (17) designed to be stretched between the two sites (10, 11) and which is adapted to subject the cable to constant tension; a support (14) for the first site and for storing in suspension rigid pipe sections (15) mutually articulated via articulating sections (16) with rotary bends and joints, so as to shift from a storage position wherein the pipe sections (15) are suspended accordion-like to the support (14) to a stretched position between the two sites (10, 11) by being suspended to the cable; and means for coupling (22) some of the articulating sections (16) to the support (14) or to cable (17) depending on the length of the cable stretched between the two sites (10, 11).

15 Claims, 10 Drawing Sheets

OFFSHORE LOADING SYSTEM BY SUSPENDED PIPING

BACKGROUND OF THE INVENTION

The present invention relates, in a general manner, to systems for loading and/or unloading of fluids, especially from vessels for transporting the said fluids. A preferred field of application is the transfer of liquefied natural gas between a floating production storage and offloading (FPSO) platform and an oil tanker moored near this platform.

Among the methods of exploitation of offshore oil fields, the use of these independent floating production platforms is expanding rapidly. The installations are moved successively onto the separate offshore deposits, which become economically viable once their exploitation no longer requires the installation of a permanently fixed infrastructure.

One of the key points in the chain of exploitation is the transfer of the products obtained from the FPSO to the vessel that is to transport them. This operation is carried out on the open sea and therefore is strongly dependent on the sea conditions.

For this purpose, there is already a proposal to provide the FPSO with loading arms similar to those used on wharfs, an example of which is described in document GB-2 042 466. To carry out the loading/unloading operation, the vessel and the FPSO must be moored side by side, in the same way as in a port with a jetty. However, this mooring side-by-side is only possible in a very calm sea.

The use of loading and/or unloading systems like those described in documents FR-2 469 367 and EP-0 020 267 has also been proposed. These systems include a device for transferring fluid between a loading jib mounted on the FPSO and a coupling means provided on the vessel. The transfer device comprises a system of multiple articulated segments for fluid pipe of concertina or deformable diamond-shape(s) type and actutated by cable, the ends of the network being connected, by means of bends and rotary joints, respectively to pipe sections fixed to the jib and pipe sections that are to be connected to the coupling means.

Such a system permits loading or unloading in tandem in rough seas. However, it takes up a lot of space on the FPSO.

Other systems propose the use of floating or suspended hoses between the FPSO and the vessel, which are moored side-by-side or in tandem.

Although these systems make it possible to effect loading in very rough seas, the loading rate is limited by the flow rate in the hoses. Furthermore, these hoses offer limited resistance to pressure surges and the large radius of curvature of the hoses means that a large storage volume is required (large-diameter drum). This type of hose also has a limited service life and requires restricting periodical tests. Above all, however, the present state of hose technology does not permit cryogenic transfer.

In other embodiments, hoses joined by rotary joints form product lines that are supported by an articulated metal structure.

SUMMARY OF THE INVENTION

The present invention aims to improve the conditions of transfer of fluid between two locations, in particular between a first location on a floating production storage and offloading platform and a second location on a vessel that is to transport the fluid.

For this purpose, it proposes an arrangement for transferring fluid between a first location and a second location, comprising:

- a control winch under constant tension that is to be installed at the first location, on which a suspension cable is wound which is to be stretched between the two locations and which is able to subject the suspension cable to a constant tension;
- a storage stand that is to be installed at the first location for storing suspended rigid pipe elements that are articulated together by means of articulation sections provided with bends and rotary joints, in a manner that makes it possible to pass from a storage position in which the pipe sections are suspended in concertina fashion on the storage stand to a position spread out between the two locations by suspension from the cable for carrying out the transfer of fluid; and
- means for coupling certain predetermined articulation sections to the storage stand or to the suspension cable depending on the length of suspension cable stretched between the two locations.

Such an arrangement with rigid pipework, with the individual elements connected together with rotary joints, permits a high fluid velocity and hence a high transfer rate. It also gives the pipework good resistance to pressure surges.

In addition, it makes it possible to transfer liquefied natural gas using existing cryogenic rotary joints, such as Chicksan® rotary joints.

Furthermore, as the suspension cable is subjected to a constant tension, it is wound onto its winch or unwound from the latter as a function of the movement of mutual separation or approach of the two structures. The number of predetermined articulation sections hung on this suspension cable therefore depends on the length of the latter stretched between the two structures.

Preferably, the coupling means comprise a plurality number of struts for suspending the predetermined articulation sections, to each of which a collet is fixed transversely for holding the suspension cable from above, to fix the suspension strut to the suspension cable, and the arrangement includes in addition a connecting winch that is to be installed at the second location, on which a connecting cable is wound, and this is to be connected to the suspension cable for taking it, prior to transfer of fluid, to the second location and securing it there or for bringing it back, after transfer of fluid, to the first location, all the while subjecting it to a constant tension by means of the constant-tension control winch.

On account of these arrangements, the connecting winch extracts the suspension cable and the articulated pipe sections from the storage stand, whereas the constant tension of the constant-tension control winch resists the exit of this cable and limits the deflection or sag of the suspended assembly.

For taking the connecting cable to the first location and connecting it to the suspension cable, the arrangement includes, advantageously, a winch that is to be installed at the first location, and on which a rope is wound, which is to be joined to the connecting cable for taking it to the first location in order to connect it to the suspension cable.

For fixing the connecting cable to the suspension cable, a mechanism with clamps, capable of firmly joining one end of the connecting cable to the suspension cable, is preferably fixed to one end of the latter.

Again preferably, the arrangement includes a device forming a mechanical stop, which is to be installed at the second location and has the purpose of locking the clamping mechanism, once the suspension cable is stretched between the two locations.

For reasons of convenience, the arrangement includes a means of fluid connection on an end pipe section and it is intended to be connected to a complementary means of fluid connection that is to be installed at the second location for executing the transfer of fluid.

According to characteristics that are preferred from the standpoint of the possibilities of movement offered by the latter:

at least some of the articulation sections that are to be hung from the suspension cable have a combination of a rotary joint with approximately vertical axis and of at least one rotary joint with approximately horizontal axis, with the pipe sections in the spread-out position; and/or the coupling means have a plurality of suspension struts, each of which has a collet for holding the suspension cable from above, fixed transversely to one of its ends, and is joined to an articulation section by means of a pivot whose axis is roughly parallel to the direction of extension of the channel for receiving the suspension cable defined by the collet; and/or the coupling means have a plurality of suspension struts, each of which is joined to the articulation section by means of a rolling bearing.

According to a preferred embodiment, the storage stand is mounted freely pivoting in azimuth on a base that is to be fixed at the first location and the arrangement includes in addition at least two sets of pulleys for lateral guidance of the suspension cable, fixed to the storage stand in different locations and capable of moving away from the suspension cable alternately on passage of a coupling means.

Due to these arrangements, the storage stand is aligned automatically on the suspension cable, while offering lateral flexibility of the product line formed by the pipe sections.

According to one embodiment variant, the storage stand is mounted pivoting in azimuth on a base that is to be fixed at the first location and the arrangement includes in addition a detector of the angular position of the suspension cable and a device for rotational control of the storage stand about the base, which is sensitive to filtered output signals of the detector for aligning the storage stand in the principal direction of the suspension cable.

According to another variant, the storage stand is connected rigidly to a base that is to be fixed to the first location, each articulation section that is to be hung on the suspension cable has a combination of a rotary joint with approximately vertical axis and of at least one rotary joint with approximately horizontal axis, with the pipe sections in the spread-out position; and the assembly has at least two sets of pulleys for lateral guidance of the suspension cable, fixed to the storage stand in two different locations and capable of moving away from the suspension cable alternately on passage of a coupling means.

According to preferred characteristics for their convenience of implementation, the coupling means have a plurality of suspension struts, to each of which a collet is fixed transversely for clamping the suspension cable from above, each of the collets having two articulated arms, which are moved towards a clamping position of the collet by the action of a spring, and each one provided with a roller, and the stand having two rails, each defining a rolling track for one of the rollers of the collet, the spacing of the rails being such that in the position of storage of the pipe sections, the collet is maintained in an open position against the force of the spring, permitting engagement of the latter on the suspension cable during passage of the pipe sections to the spread-out position.

For supporting the suspension cable as it leaves the storage stand, the arrangement includes, advantageously, suspension cable supporting pulleys, downstream from the rails of the storage stand.

The present invention also proposes the use of the arrangement described above for the transfer of liquefied natural gas between a floating production storage and off-loading platform representing the first location and a vessel representing the second location, the pipe sections being connected by articulations to other pipe sections to form two pipelines for transfer of fluid which can be deployed simultaneously and parallel between the two locations, one of these pipelines serving for transfer of liquefied natural gas to the vessel and the other serving for return, of the vapour to the platform.

The present invention will be better understood on reading the description that follows, referring to the appended drawings which show, as examples, non-limiting embodiments of the present invention.

DETAILED DESCRIPTION OF THE PREFERRED EMBODIMENT

Figure 1:
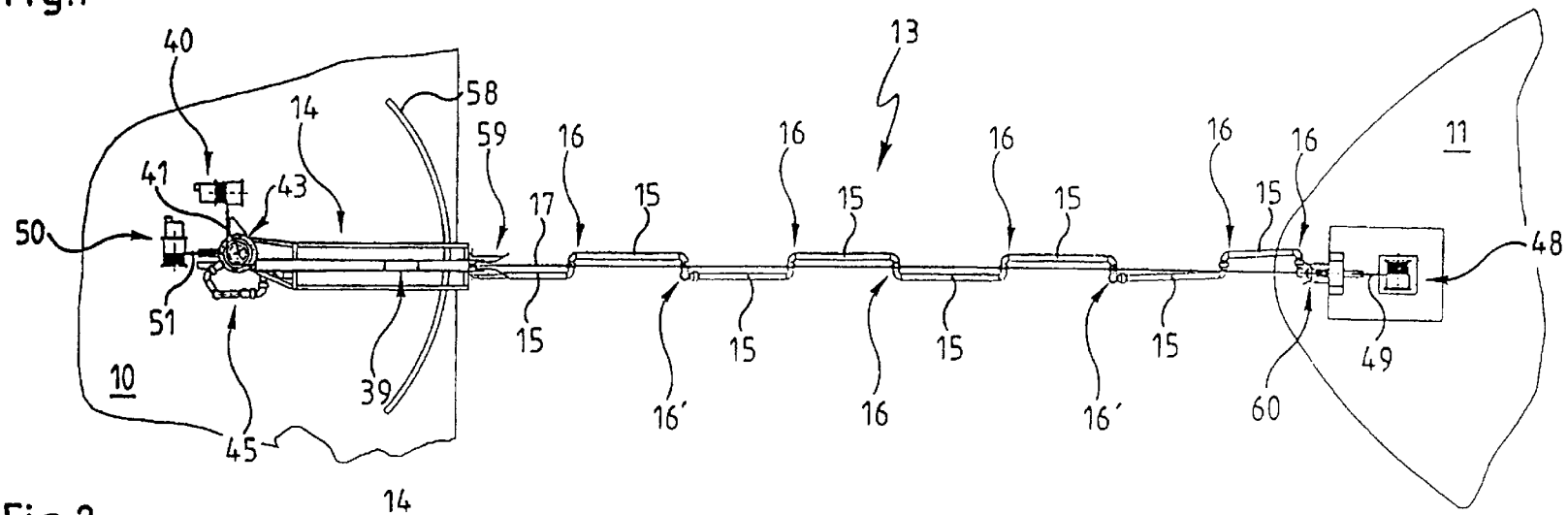
FIG. 1 is a plan view according to a preferred embodiment of the invention.

In FIG. 1, a part of an independent production platform is shown at 10. A tanker 11 is moored by means of a hawser 12 to platform 10. An arrangement for transfer of fluid 13 according to a preferred embodiment of the invention makes it possible to transfer, in this case, crude oil extracted on platform 10 to the tanker 11.

Figure 2:
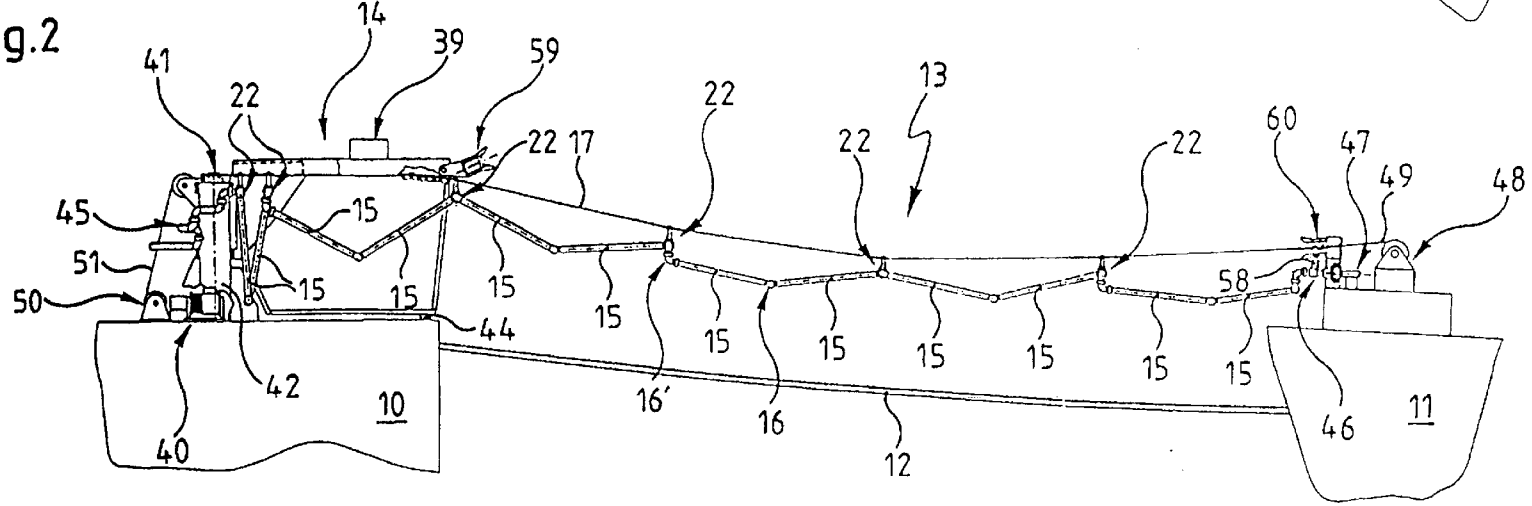
FIG. 2 is a side view of the same arrangement.

For this purpose, arrangement 13 includes a stand 14 installed on platform 10 for storing, suspended, a number of rigid pipe sections 15 for transfer of fluid, crude oil in this instance, articulated together by means of articulation sections 16, 16' provided with 90° bends and rotary joints, in such a way that they are able to pass from a storage position in which the pipe sections 15 are suspended in concertina fashion on stand 14 to a spread-out position between platform 10 and tanker 11 by suspension from a suspension cable or carrying cable 17 for executing the transfer of fluid (see FIG. 2, where the two positions are illustrated).

Figure 18:
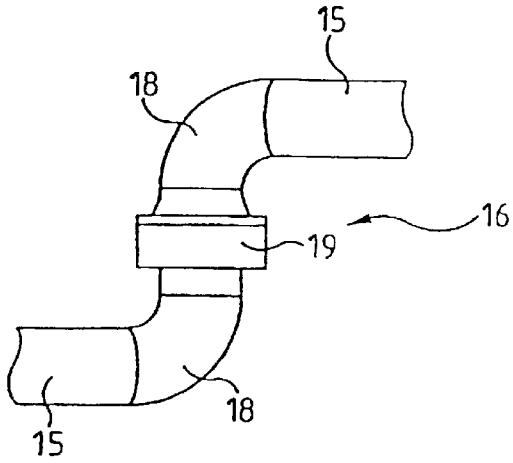
FIG. 18 is an enlarged view of a first type of articulation section employed in the arrangements in FIGS. 1, 2, 11, 12, 15 and 16.

As can be seen more clearly in FIG. 18, the articulation sections 16 each have two 90° bends 18 connected at one end to an end of a rigid pipe section 15 and at their other end to the next 90° bend 18, by means of a rotary joint 19. The axis of this rotary joint 19 is approximately horizontal and perpendicular to the suspension cable 17, when the articulation section 16 is suspended from it (see FIG. 1). This type of rotary joint 19 allows the pipe sections 15 to follow the curve of suspension cable 17 in the vertical plane, in the spread-out position of these pipe sections 15, but also allows these pipe sections 15 to be folded for storage in concertina fashion on the storage stand or station 14.

For identical reasons, the articulation sections 16' are also each provided with a rotary joint 19' with horizontal axis between two 90° bends 18'. However, a third 90° bend 18" is provided between one of these 90° bends 18' and the end of a rigid pipe section 15. This third 90° bend 18" is connected to the next 90° bend by a rotary joint 20 with approximately vertical axis in the spread-out position, permitting sideways movements of pipe sections 15. These sideways movements enable the assembly to respond to the oscillating movements of tanker 11 and platform 10 during transfer. Furthermore, the twisting of this line is absorbed by an additional rotary joint 21 connecting the third 90° bend 18" of articulation section 16' to one end of pipe section 15 with which rotary joint 21 is aligned.

As can be seen in FIG. 1, because of these articulation sections 16, 16', the pipe sections 15 are thus positioned alternately on either side of suspension cable 17 in the spread-out position.

It will also be noted that in the present preferred embodiment, every fourth articulation section is of the type with a vertical-axis rotary joint.

Coupling means are also provided for suspending these pipe sections 15 on storage stand 14 and on suspension cable 17 as a function of the length of the suspension cable 17 stretched between platform 10 and tanker 11.

As can be seen in FIG. 2, the latter have suspension struts 22 that are connected, every other pipe section 15, to an articulation section 16 or 16' at the horizontal-axis rotary joint 19 or 19', respectively.

Figure 4:
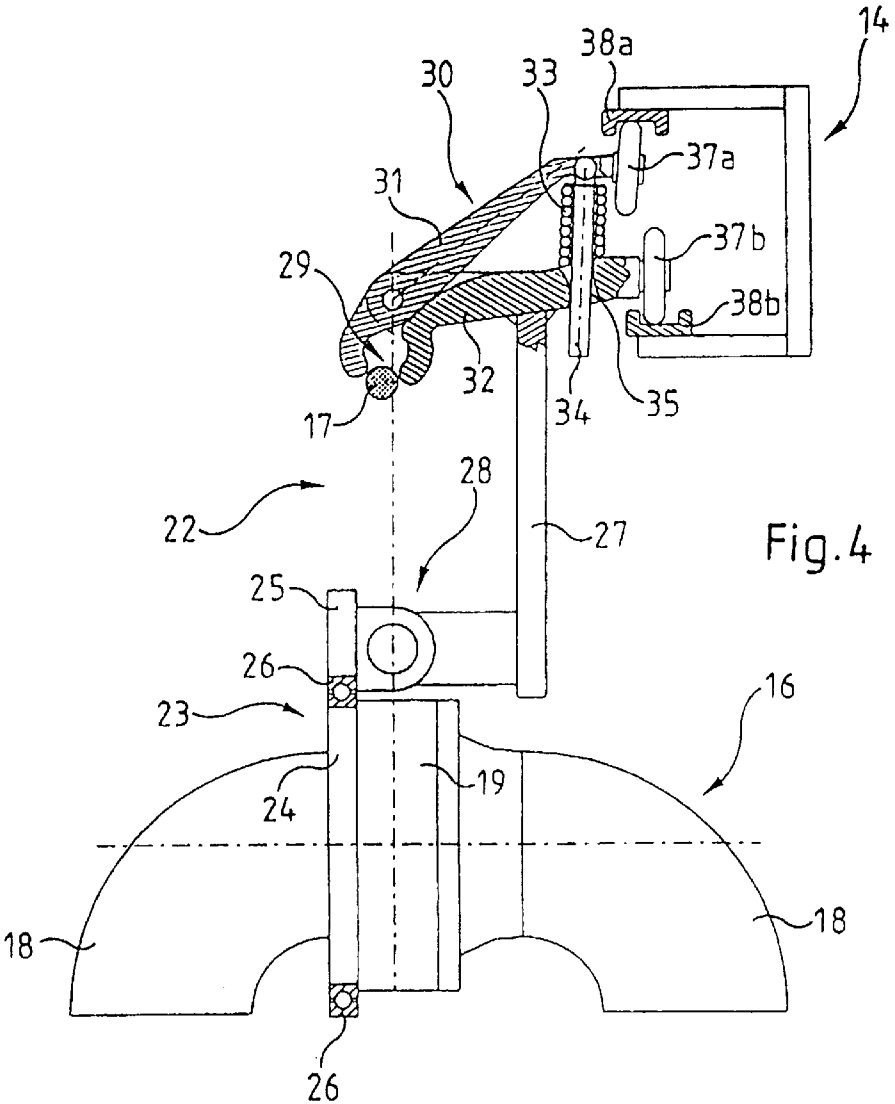
FIG. 4 is a front view, with partial sectioning, of the same suspension strut in the storage position.
Figure 3:
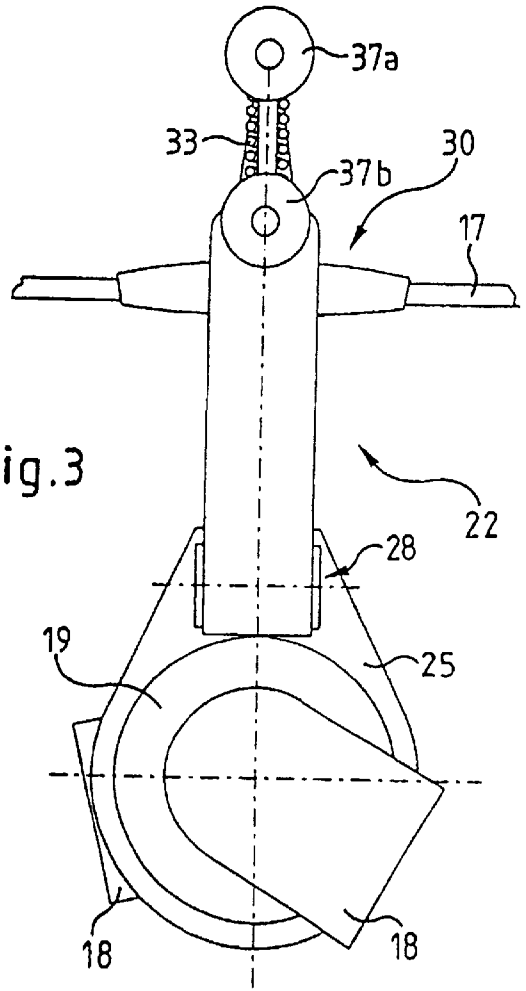
FIG. 3 is a side view of a suspension strut of an articulation section of the arrangement in FIGS. 1 and 2.

The said suspension struts 22 are shown in more detail in FIGS. 3 and 4.

As can be seen in these diagrams, each suspension strut 22 is connected to an articulation section 16 by means of a rolling bearing 23 that has an inner ring 24 and an outer ring 25, with balls 26 inserted between them. The inner ring 24 is fixed to the outside of the next rotary joint 19, whereas the outer ring 25 is connected to the end of a vertical arm 27 of suspension strut 22 via a pivot joint 28.

The axis of this pivot joint 28 is roughly parallel to the direction of extension of a receiving channel 29 defined by a collet 30 and intended to receive suspension cable 17.

This collet 30 is integral with arm 27, at its end opposite to that connected to ring 25. It has two hinged arms 31, 32 stressed towards a clamping position of collet 30 by a spring 33 that is retained between arms 31 and 32 by a rod 34 mounted pivoting on arm 31 and engaging in a hole 35 in arm 32.

It will also be noted that collet 30 is, in this case, fixed to arm 27, transversely to the latter and permits clamping of suspension cable 17 from above.

It will be appreciated that pivot joint 28 allows misalignment between suspension cable 17 and the axis of the pipe formed by pipe sections 15 in the spread-out position.

As can also be seen in FIG. 4, each of the arms 31 and 32 is also provided with a roller **37*a*, 37*b* at its end opposite to that of clamping of suspension cable 17. Each of these rollers 37*a*, 37*b* is in rolling engagement on a rail 38*a*, 38*b* of storage stand 14**.

In the storage position, the spacing of rails **38*a*, 38*b* is such that collet 30 is held in an open position, against the force of spring 33, making it possible for the latter to engage on suspension cable 17 during passage of pipe sections 15** to the spread-out position.

A control system 39 (see FIGS. 1 and 2) is mounted on storage stand 14 and is equipped with a hydraulic actuator that is able to engage a collet 30 between rails **38*a*, 38*b* or to release the said collet 30 to enable it to be coupled to suspension cable 17**.

So that suspension struts 22 are hung on suspension cable 17 with a regular spacing, the control system is connected to an angular position sensor of a constant-tension control winch 40 installed on platform 10, suspension cable 17 being wound on the said winch.

The unwound length of suspension cable 17 is measured by the angular position sensor and the corresponding information is transmitted to control system 39 which responds in the following way:

- if cable 17 is in the course of being unwound and if a predetermined spacing is reached, a collet 30 is released to enable it to grip the suspension cable 17 and therefore make an articulation section 16 or 16' integral with this cable 17;
- if the cable is in the course of being wound onto winch 40 and if there is a collet 30 in front of the control system 39, the hydraulic actuator of the latter will engage collet 30 between rails **38*a* and 38*b* and hold it in the storage position between these rails 38*a*, 38*b***.

This operating logic is applied throughout the stage of transfer of fluid between platform 10 and tanker 11, during which the separation between the latter can increase or decrease.

The constant-tension control winch 40 makes it possible to apply a constant tension to suspension cable 17 so as to maintain a roughly constant deflection at the mid-point of this cable 17. For this purpose, winch 40 is operated by a hydraulic motor that is permanently submitted to a constant pressure. If tanker 11 moves away or comes closer, suspension cable 17 is wound onto winch 40 or is unwound from it; the (slight) variation in deflection is only due to variation of the range (the distance separating platform 10 and tanker 11).

The suspension cable wound on the said winch 40 is led to storage stand 14 by a 90° return pulley 41 mounted on a base 42 fixed to platform 10.

Storage stand 14 is also mounted with azimuth pivoting on this base 42 by means of rolling bearings 43.

Storage stand 14 is in addition connected to the deck of platform 10 by rollers 44 taking the weight of stand 14.

A set 45 of other pipe sections articulated together by means of rotary joints and bends runs alongside base 42 to supply the pipeline formed by the sections 15 with crude oil, while being able to follow the pivoting of storage and 14 around base 42.

The other end of this pipeline, positioned alongside tanker 11 in the spread-out position, is provided with a double-valve hydraulic coupling 46 that is to be connected to a manifold 47 located on tanker 11.

To take suspension cable 17 and the pipe sections 15 that are fixed to it, from platform 10 to tanker 11, a winch 48, on which a connecting cable 49 is wound, is installed on the deck of tanker 11. To take connecting cable 49 from the side of platform 10 so as to be able to fix it to suspension cable 17, an ancillary winch 50 is provided on the deck of platform 10, on which a rope 51 is wound.

Figure 5:
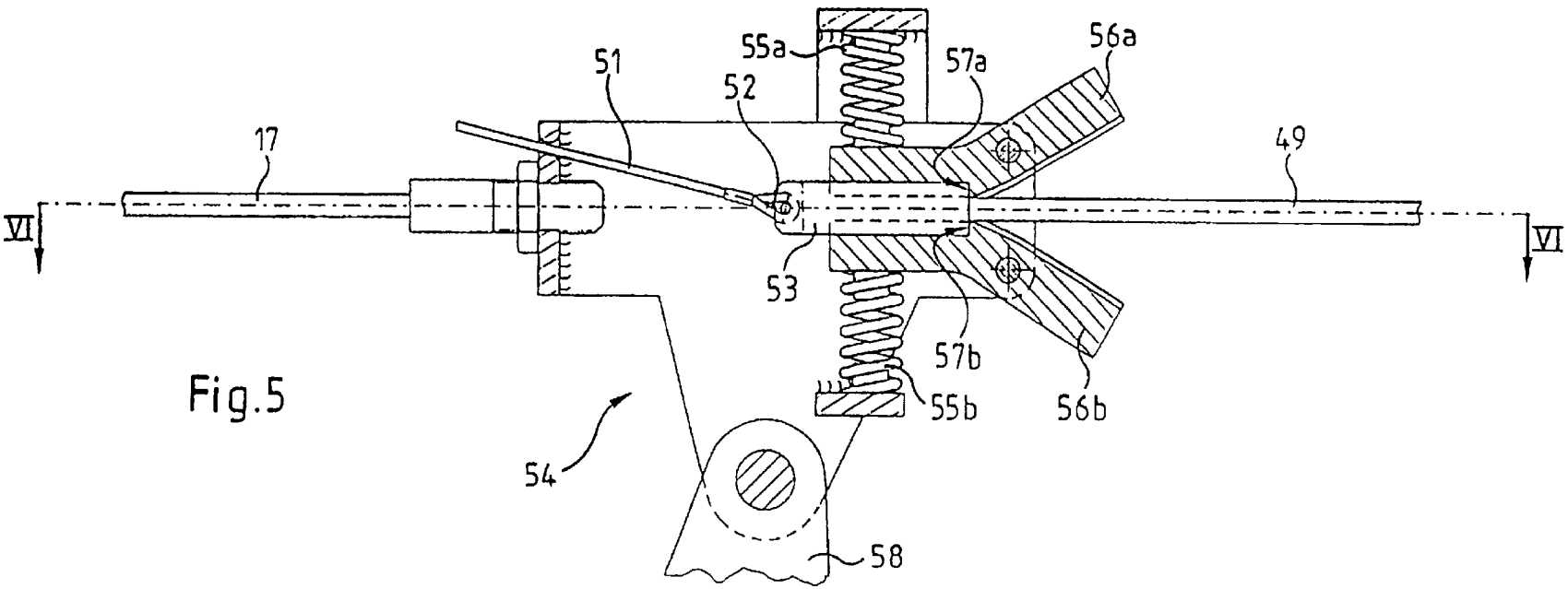
FIG. 5 is a view in longitudinal section of a clamping mechanism of the arrangement in FIGS. 1 and 2.
Figure 6:
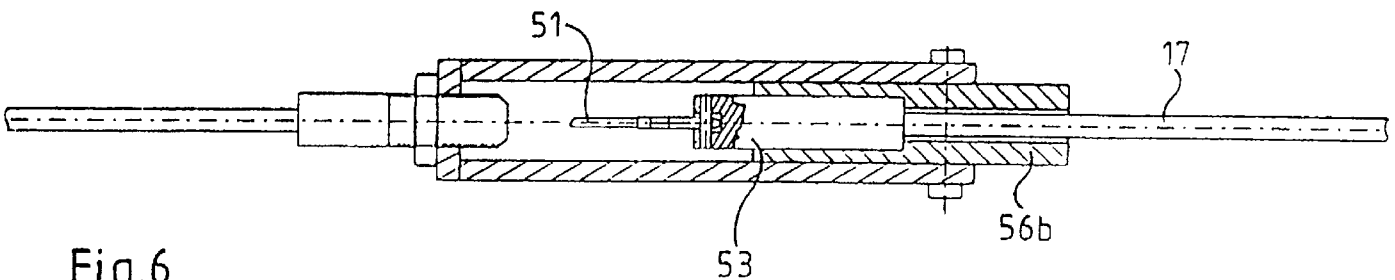
FIG. 6 is a sectional view along line VI—VI in FIG. 5, with partial sectioning.

As can be seen in FIG. 5, this rope 51 is provided, at one of its ends, with a loop 52 for coupling rope 51 to a socket 53 fixed on one end of connecting cable 49.

To fix suspension cable 17 to connecting cable 49, once the latter has been brought from the side of platform 10, a clamping mechanism 54 is fixed to one end of suspension cable,17. Two return springs 55*a*, 55*b* hold socket 53 in place between jaws 56*a*, 56*b* when the cables are slackened. On the other hand, the tension of the cables tends to tighten jaws 56*a*, 56*b* on socket 53, because the latter will, in the connected position, butt against a shoulder 57*a*, 57*b* of each of the jaws 56*a*, 56*b*, which has the effect of causing the latter to pivot towards their holding position of socket 53.

FIG. 5 also shows a part of a strut 58 with pivoting mounting on clamping mechanism 54; coupling 46 is fixed to this strut (see FIG. 2).

As can be seen in FIGS. 1 and 2, a first device forming a mechanical stop 59 is fixed to the storage stand 14 and a second device forming a mechanical stop 60 is installed on the deck of tanker 11, close to manifold 47. The first device forming stop 59 has the purpose of locking the clamping mechanism 54 as long as the procedure for deployment of suspension cable 17 and pipe sections 15 has not started, whereas the second device forming mechanical stop 60 serves the purpose of locking this same clamping mechanism 54, once the suspension cable 17 is stretched between platform 10 and tanker 11.

In the case of the present embodiment, the tensile force of suspension cable 17 is applied to base 42 via return pulley 41. Storage stand 14 only bears the weight of pipe sections 15. The said stand 14, which can turn freely about base 42, must therefore be aligned on suspension cable 17. This alignment is obtained by means of lateral guidance pulleys, which can be seen in FIGS. 7 to 10.

Figure 8:
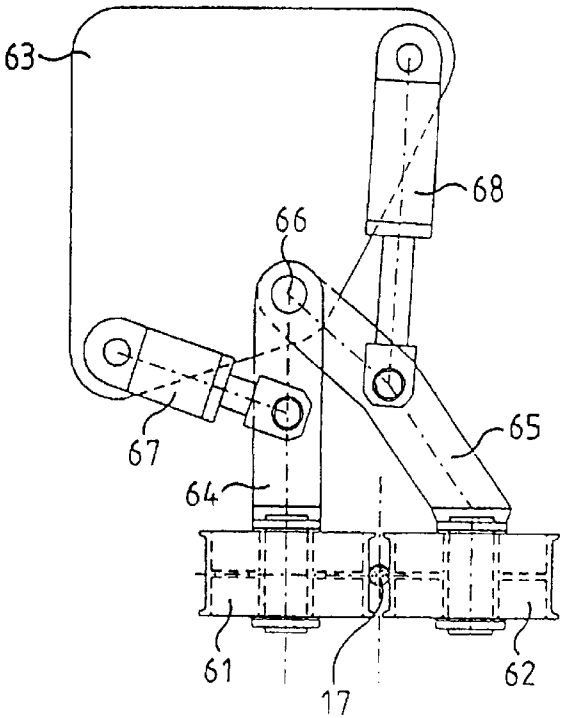
FIG. 8 shows the same guidance means, in position for guiding the suspension cable.
Figure 7:
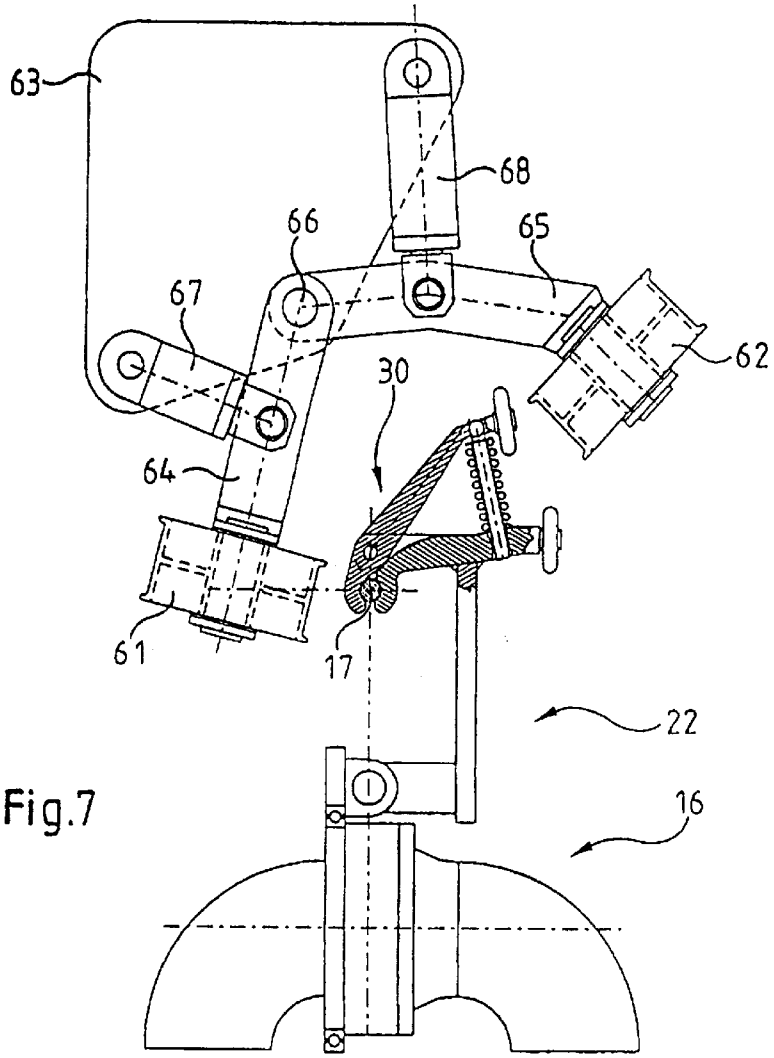
FIG. 7 is a schematic illustration of the positioning of the means for lateral guidance of the suspension cable of the arrangement in FIGS. 1 and 2, on passage of the suspension strut shown in FIGS. 3 and 4.

FIGS. 7 and 8 show a set of two pulleys 61 and 62 each mounted with pivoting on a supporting plate 63 by means of arms 64 and 65, respectively.

These arms 64 and 65 are actuated so that they pivot about a common pivot 66 by means of two hydraulic jacks 67 and 68 each of which is fixed to the supporting plate 63, on the one hand, and to one of the arms 64 and 65, on the other hand.

Supporting plate 63 itself is fixed to storage stand 14.

Thus, in a position shown in FIG. 8, where these pulleys 61 and 62 are in contact with the suspension cable 17, on either side of the latter, any displacement of the said suspension cable 17 leads to a pivoting of storage stand 14 on base 42, keeping storage stand 14 aligned with suspension cable 17 and, in consequence, also with the axis of the pipeline for transfer of fluid spread out between platform 10 and the tanker 11.

As a result of this, the storage stand 14 is aligned automatically on suspension cable 17.

On passage of a suspension strut 22 (see FIG. 7), the pulleys 61 and 62 are withdrawn from suspension cable 17 by operation of the hydraulic jacks 67 and 68. The simplicity of such a system with two hydraulic jacks ensures good mechanical reliability.

However, for good lateral guidance to be maintained at all times, in fact two sets of pulleys are provided in different locations, and these move aside alternately during passage of a suspension strut 22.

Figure 9:
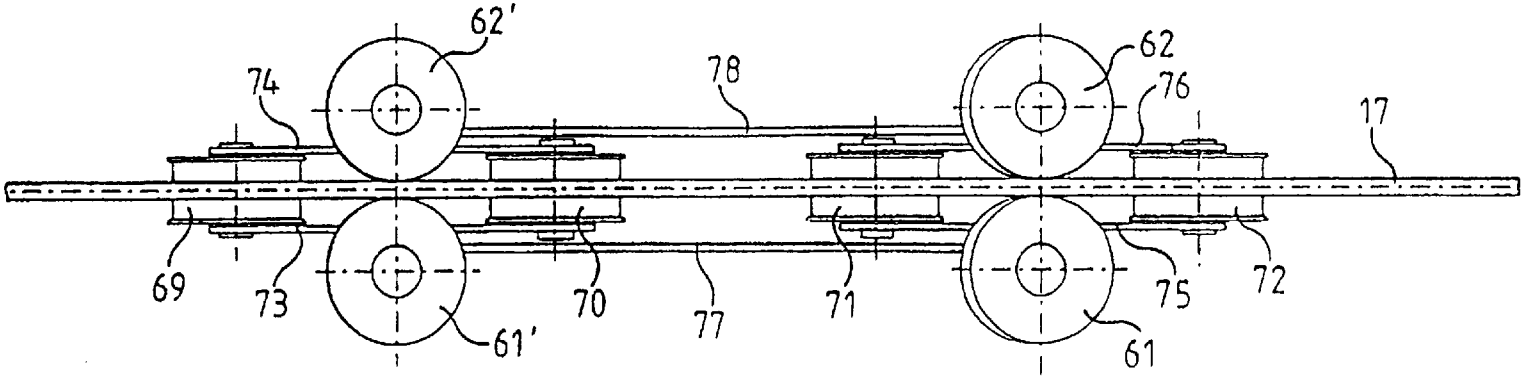
FIG. 9 is a plan view of a system of suspension cable supporting pulleys.
Figure 10:
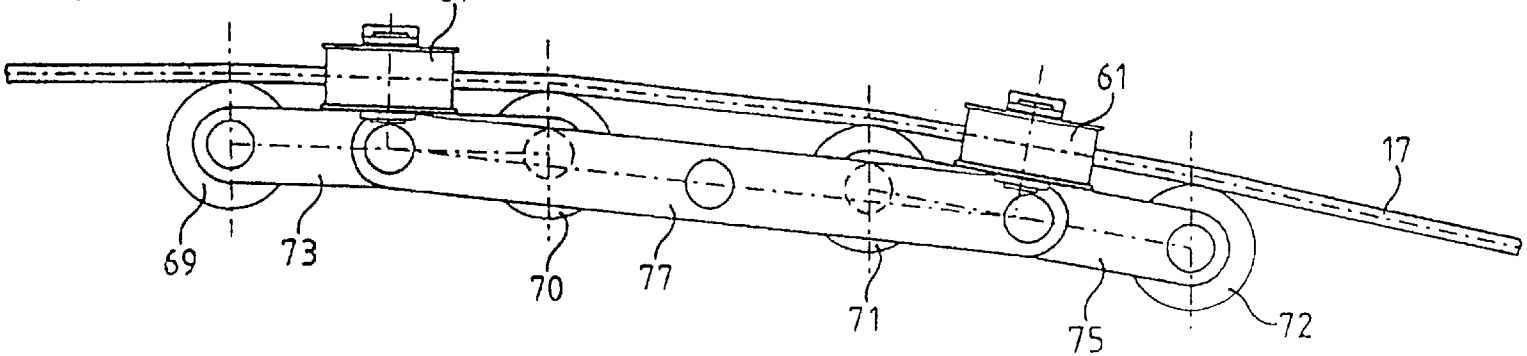
FIG. 10 is a side view of the system in FIG. 9.

These two sets of pulleys are shown without their manoeuvring means in FIGS. 9 and 10. The first set of pulleys 61, 62, which are also shown in FIGS. 7 and 8, can be seen, as well as the second set of pulleys 61', 62' positioned on either side of the suspension cable 17, upstream of the first set of pulleys 61, 62.

Owing to the alternating movements of tanker 11 during the loading phase of the latter, a suspension strut 22 can stop at any point of this pulley-based guidance system, and then start moving again in either direction, or may even oscillate about one position.

Accordingly, the control system 39 is connected to a position detector to allow it to change the order of the operations of withdrawal of the two sets of pulleys, depending on the detected position of a suspension strut 22.

FIGS. 9 and 10 also show pulleys 69–72 for taking up the weight of the sections 15 on exit from storage stand 14.

These pulleys 69–72 are connected, two by two, by connecting bars 73–76, which in their turn pivot on intermediate bars 77 and 78 for suspending pulleys 69–72 on storage stand 14.

The arrangement for transfer of fluid 13 operates in the following way:

Before the arrangement for transfer of fluid 13 is put in place, the pipe sections 15 are in the retracted position, i.e. they are suspended in concertina fashion on storage stand 14.

For putting the arrangement for transfer of fluid 13 in place, first of all, rope 51 is taken from platform 10 to tanker 11, for example passing it across at the same time as hawser 12. An operative on tanker 11 then connects this rope to the end of connecting cable 49, wound on its winch 48.

Once connected, rope 51 is wound onto its winch 50. It pulls on connecting cable 49, which is unwound from its winch 48. When the end of connecting cable 49 arrives at storage stand 14, it is connected automatically to the end of suspension cable 17. More precisely, socket 53 of connecting cable 49 separates the jaws 56*a*, 56*b* of clamping mechanism 54 and is held in position. Once connecting cable 49 is connected to suspension cable 17, the connecting winch 48, on tanker 11, is started up, withdrawing from storage stand 14 the suspension cable 17 and the pipe sections 15 which are fixed to it progressively. The constant tension applied by winch 40 opposes exit of the suspension cable 17 and limits the deflection of the suspended arrangement for transfer of fluid 13. As for the suspension struts 22, they are fixed to this suspension cable 17 with regular spacing.

When the end of suspension cable 17 arrives at tanker 11, the device for mechanical stop 60 locks the clamping mechanism 54. The connecting winch 48 is then stopped and hydraulic coupling 46 is connected to a flange of manifold 47.

The valves of coupling 46 are then opened and loading of tanker 11 can begin.

For the entire duration of the loading operation, the pipe sections 15 are retracted or come out of the storage stand, depending on the distance between platform 10 and tanker 11.

For disconnection, the order of the operations is reversed and the movements are performed in the opposite direction. However, the principle of maintaining constant tension from platform 10 is preserved.

It will be appreciated that this arrangement for transfer of fluid 13 allows considerable relative movement in all directions.

In addition, it allows a high fluid velocity and in consequence a high transfer rate, while offering good resistance of the pipeline to pressure surges.

The variant of implementation shown in FIGS. 11 to 14 proposes a system for rotational control of the storage stand.

Figure 11:
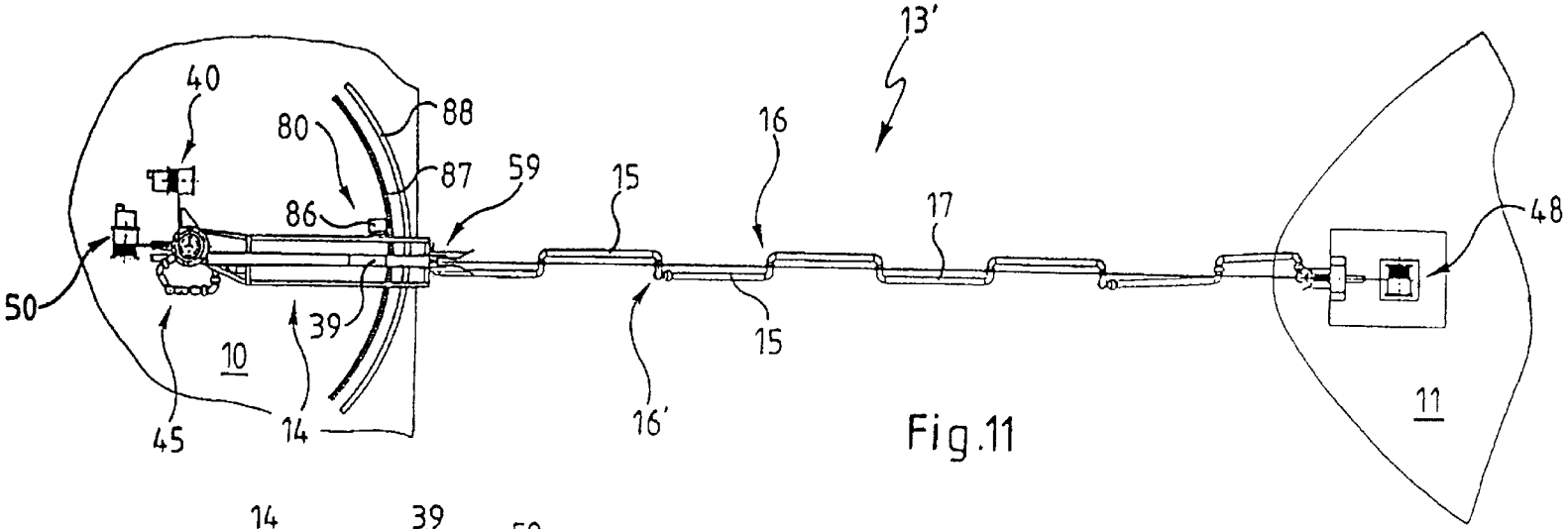
FIG. 11 is a plan view of one variant of implementation of the arrangement for transfer of fluid.
Figure 12:
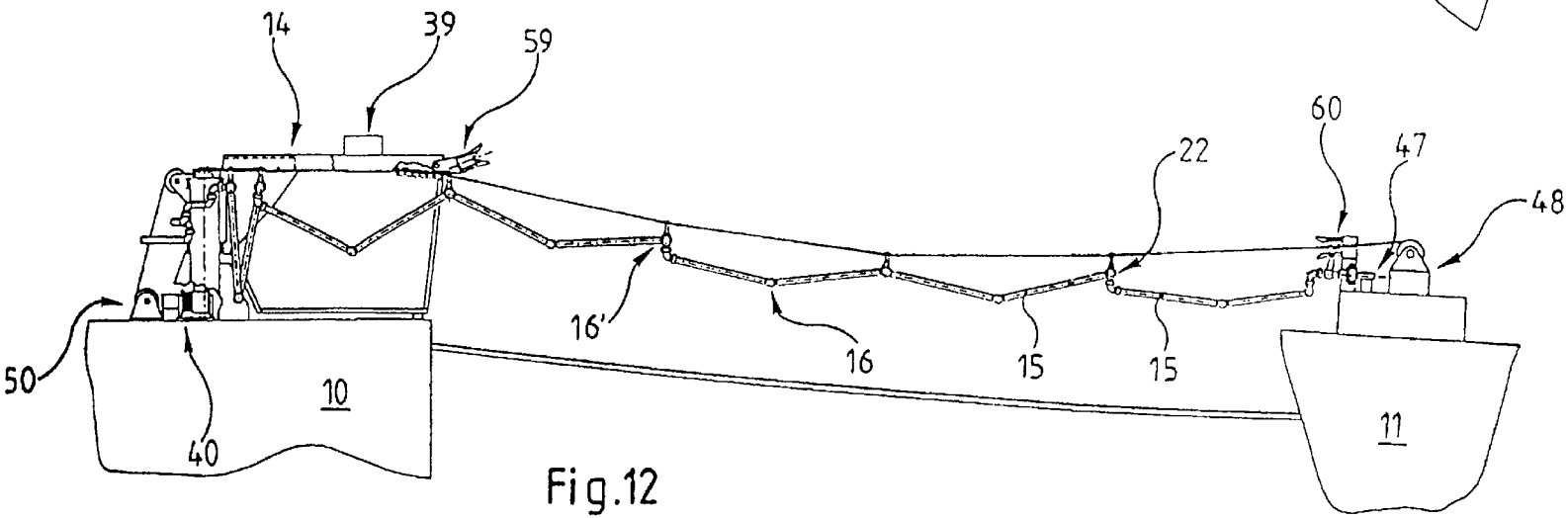
FIG. 12 is a side view of the arrangement in FIG. 11.
Figure 13:
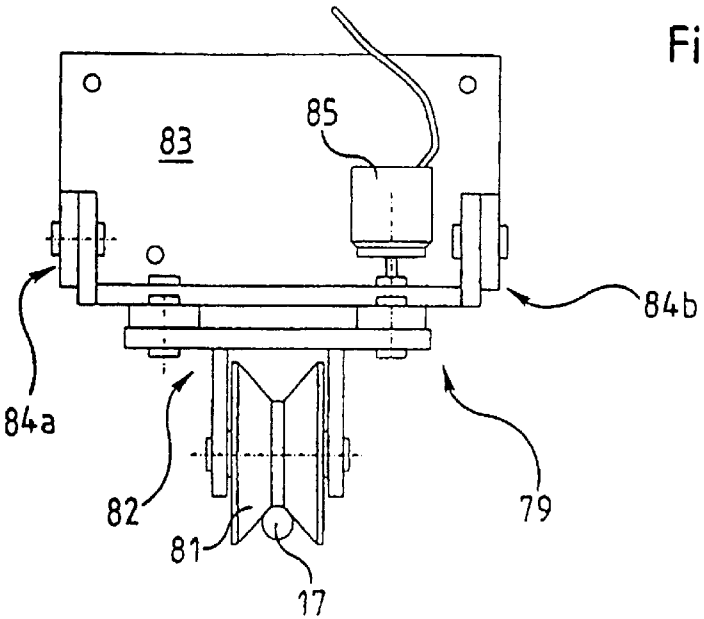
FIG. 13 is a front view of a device for detecting the angular position of the suspension cable of the arrangement in FIGS. 11 and 12.
Figure 14:
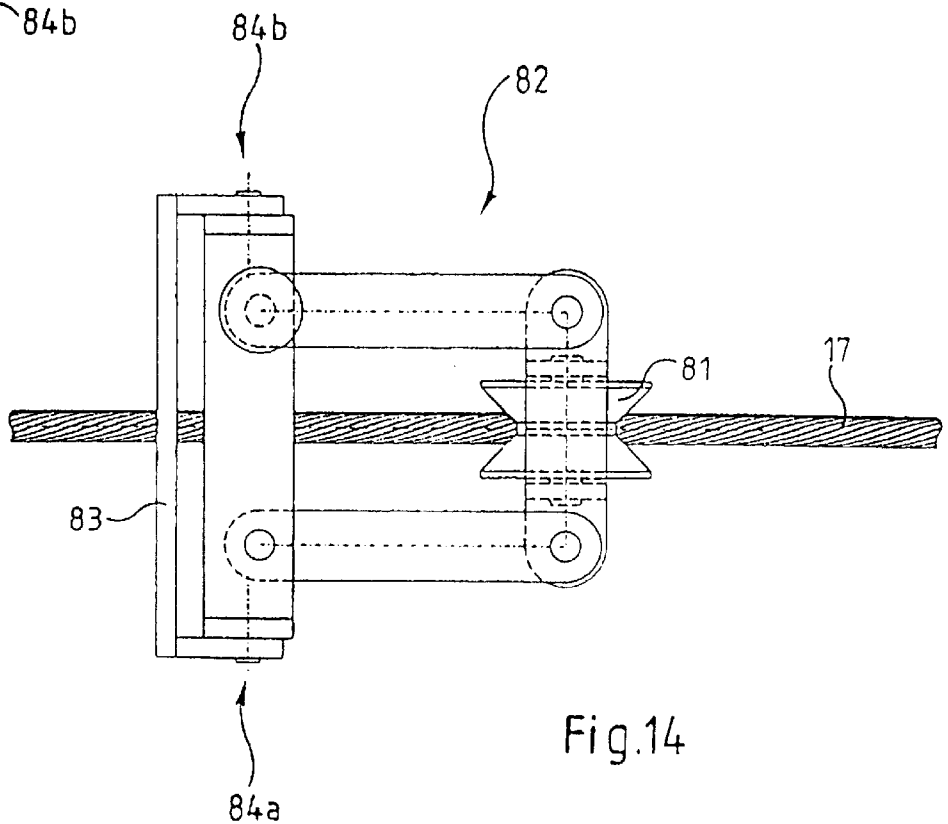
FIG. 14 is a plan view of the device in FIG. 13.

More precisely, the pulley system for lateral guidance of suspension cable 17 in FIGS. 1 to 10 is replaced with a system for rotational control of storage stand 14, comprising an angular position detector 79 of suspension cable 17 (see FIGS. 13 and 14) and a device for rotational control 80 of storage stand 14 about base 42 (see FIG. 11).

The lateral direction of suspension cable 17 leaving storage stand 14 is measured by means of an idling roller 81 resting on the said cable 17. This idling roller 81 is able to follow the sideways movements of cable 17 because it is mounted on a hinged support 82 mounted on a plate 83 fixed to storage stand 14 by means of two height-compensating hinges 84*a* and 84*b*.

Hinged support 82 is also connected to a rotation encoder 85.

The output signal from this encoder 85, representing the angular position of suspension cable 17, has been filtered so as to remove the intrinsic oscillations of the cable. This signal is transmitted to a hydraulic motor 86 of the device for rotational control 80 to align storage stand 14 with the principal direction of suspension cable 17 by means of a system of the rack and pinion type, in which the pinion is mounted on the output shaft of hydraulic motor 86 and the rack 87 is mounted on the deck of platform 10, behind the rolling track 88 of rollers 44.

Otherwise, the arrangement for transfer of fluid 13' in FIGS. 11 to 14 is identical in all respects to the arrangement for transfer of fluid 13 in FIGS. 1 to 10.

Figure 15:
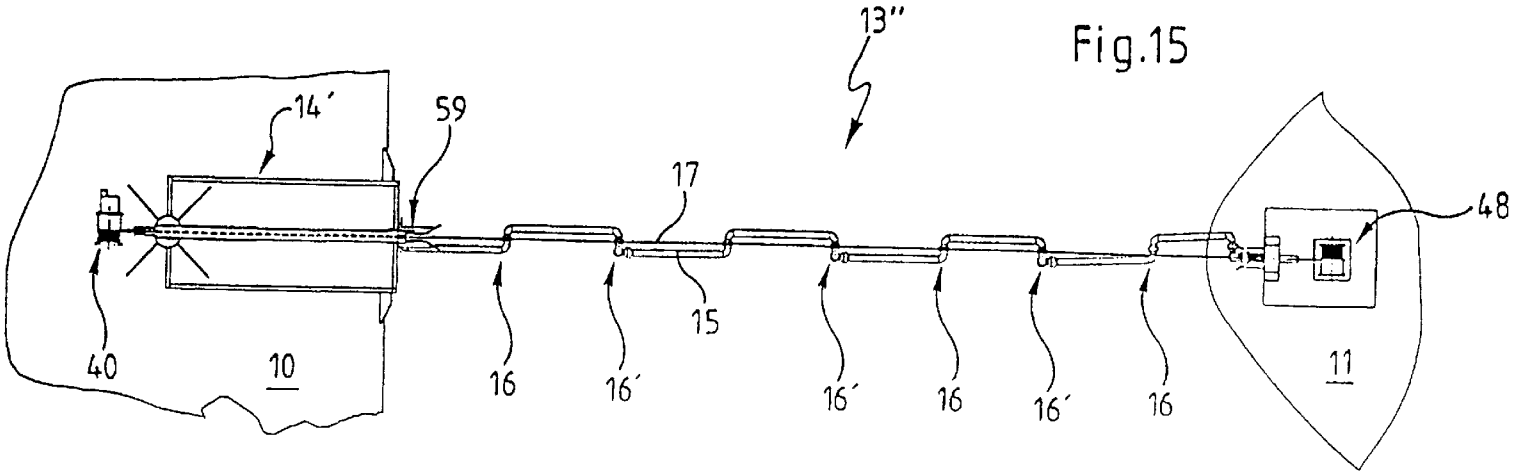
FIG. 15 is a plan view of another variant of implementation of the arrangement for transfer of fluid.
Figure 16:
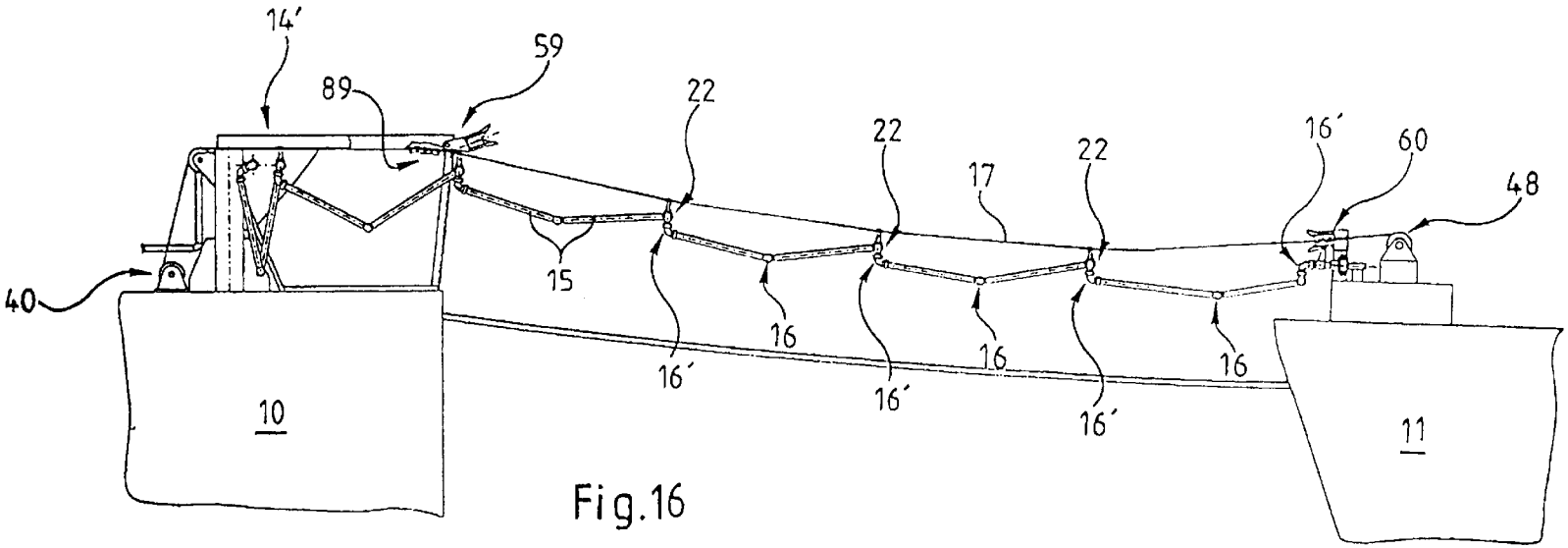
FIG. 16 is a side view of the arrangement in FIG. 15.

In the case of the variant of implementation in FIGS. 15 and 16, the storage stand 14' of the arrangement for transfer of fluid 13" is connected rigidly to platform 10.

The sideways movements of tanker 11 relative to platform 10 are therefore completely absorbed at the outlet of storage stand 14' by the suspension cable 17 and the pipeline for transfer of fluid formed by the pipe sections 15.

Accordingly, the arrangement for transfer of fluid 13" includes a system 89 for lateral guidance of suspension cable 17 as it leaves storage stand 14', similar to that described with reference to FIGS. 7 to 10.

Figure 19:
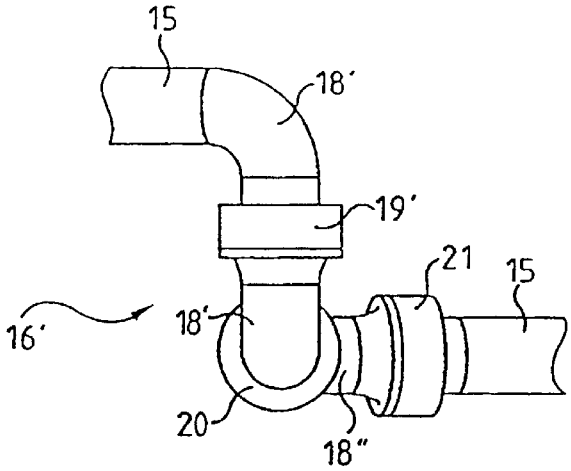
FIG. 19 is an enlarged view of a second type of articulation section employed in the arrangements in FIGS. 1, 2, 11, 12, 15 and 16.

In addition, articulation sections with a rotary joint with an approximately vertical axis, of the type of those shown in FIG. 19, are positioned on each suspension strut 22.

Otherwise the operation of this arrangement for transfer of fluid 13" is similar to that in FIGS. 1 to 10.

It should be noted that the winch on which the rope is wound is not shown in FIGS. 15 and 16. This winch is identical to those shown in the other diagrams and can, for example, be located behind winch 50.

Figure 17:
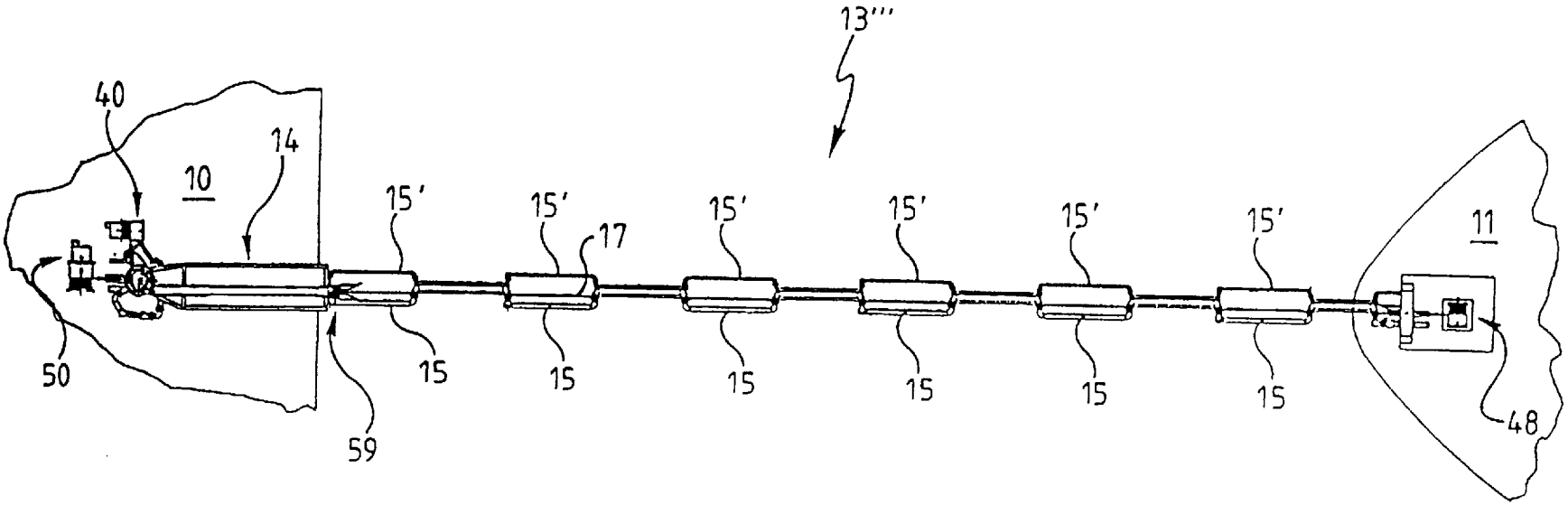
FIG. 17 is a plan view of a variant of implementation of the arrangement for transfer of fluid for the transfer of liquefied natural gas.

Another embodiment of the arrangement for transfer of fluid is shown in FIG. 17.

This arrangement for transfer of fluid 13'" is intended for transfer of liquefied natural gas from platform 10 to tanker 11. For this purpose it has a second network of pipe sections 15' forming a pipeline for return of vapour from tanker 11 to platform 10.

Figure 20:
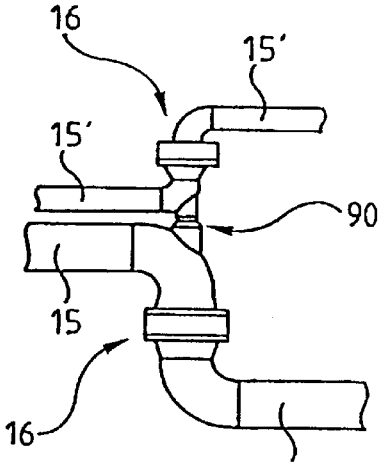
FIG. 20 is an enlarged view of a first type of articulation section employed in the arrangement in FIG. 17.
Figure 21:
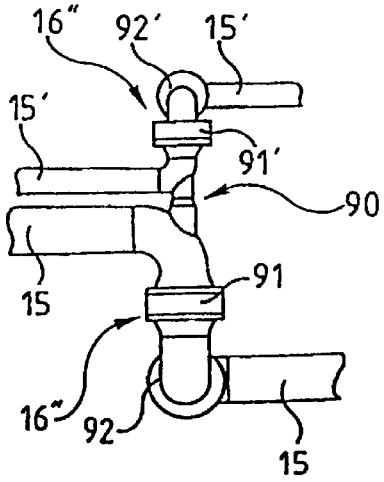
FIG. 21 is an enlarged view of a second type of articulation section employed in the arrangement in FIG. 17.

As can be seen in FIGS. 20 and 21, the pipe sections 15' for vapour return are of smaller diameter than pipe sections 15 for transfer of liquefied natural gas.

Transfer of liquefied natural gas is carried out at a temperature of about −160° C., therefore all of the rotary joints used in this embodiment are cryogenic rotary joints of Chicksan® type joints.

Furthermore, so as to be able to deploy the two pipelines simultaneously and parallel between platform 10 and tanker 11, the respective articulation sections 16, 16" are joined together by means of transverse articulations 90, as shown in FIGS. 20 and 21.

In this respect, it should be noted that the articulation sections 16" in FIG. 21 each have just one rotary joint with approximately horizontal axis 91, 91' associated with a joint with approximately vertical axis 92, 92'.

As for the articulation sections 16 in FIG. 20, they are identical to that shown in FIG. 18.

Of course, the invention is in no way limited to the embodiments that have been described and illustrated, which have only been given as examples.

In particular, it comprises all means that constitute technical equivalents of the means described, as well as their combinations.

Furthermore, the arrangement for transfer of fluid according to the present invention can be used for transferring fluids other than crude oil and liquefied natural gas. Among these fluids, liquefied petroleum gas and condensates, can in particular be mentioned.

What is claimed is:

1. An arrangement for the transfer of fluid between a first location and a second location, comprising:

a constant-tension control winch which is installed at the first location and on which is wound a suspension cable that is strechable between the first and second locations, the control winch subjecting the suspension cable to a substantially constant tension;

a storage stand which is installed at the first location and on which are suspended in storage a plurality of rigid pipe sections that are articulated together by corresponding articulation sections which each comprise one or more bends and rotary joints;

wherein the pipe sections can pass from a storage position in which the pipe sections are suspended in concertina fashion on the storage stand to a position where they are spread out between the first and second locations on the suspension cable for executing the transfer of fluid; and means for coupling predetermined ones of the articulation sections to the storage stand or to the suspension cable as a function of the length of suspension cable stretched between the first and second locations.

2. An arrangement according to claim 1, wherein:

the coupling means comprises a number of suspension struts, each of which is connected to a corresponding one of the predetermined articulation sections and to each of which is connected a collet for gripping the suspension cable to thereby secure the suspension strut to the suspension cable; and the arrangement further includes a connecting winch which is installed at the second location and on which is wound a connecting cable that is connectable to the suspension cable to enable the suspension cable to be carried to the second location prior to the transfer of fluid and back to the first location after the transfer of fluid, all the while the suspension cable is subjected to a constant tension by means of the constant-tension control winch.

3. An arrangement according to claim 2, further comprising a winch which is installed at the first location and on which is wound a rope that is connectable to the connecting cable for taking the connecting cable to the first location to be connected to the suspension cable (17).

4. An arrangement according to claim 2, further comprising a clamping mechanism attached to the suspension cable for securing one end of the connecting cable to the suspension cable.

5. An arrangement according to claim 4, further comprising a mechanical stop which is installed at the second location and which locks the clamping mechanism once the suspension cable has been stretched between the first and second locations.

6. An arrangement according to claim 1, further comprising a fluid connection on an end pipe section which is connectable to a complementary fluid connection installed at the second location for executing the transfer of fluid.

7. An arrangement according to claim 1, wherein the predetermined ones of the articulation sections each comprises a combination of at least one first rotary joint with an approximately vertical axis and at least one second rotary joint with an approximately horizontal axis, in the spread-out position of the pipe sections.

8. An arrangement according to claim 1, wherein the coupling means includes a plurality of suspension struts, each of which has a collet for gripping the suspension cable from above and is connected to a corresponding articulation section via a pivot joint whose axis is roughly parallel to a direction of extension of an extendable channel of the collet into which the suspension cable is received.

9. An arrangement according to claim 1, wherein the coupling means includes a plurality of suspension struts, each of which is attached to a corresponding articulation section by means of a rolling bearing.

10. An arrangement according to claim 1, wherein the storage stand is mounted pivotable in azimuth on a base that is fixed at the first location and the arrangement further includes at least two sets of pulleys for lateral guidance of the suspension cable, the pulleys being fixed to the storage stand at different locations and movable away from the suspension cable on passage of the coupling means.

11. An arrangement according to claim 1, wherein the storage stand is mounted pivotable in azimuth on a base that is fixed at the first location and the arrangement further includes a detector of the angular position of the suspension cable and a device for controlling the rotation of the storage stand about the base, the controlling device being sensitive to filtered output signals from the detector for aligning the storage stand with the principal direction of the suspension cable.

12. An arrangement according to claim 1, wherein:

the storage stand is rigidly connected to a base that is fixed at the first location;

each of the predetermined ones of the articulation sections comprises at least one first rotary joint with an approximately vertical axis and at least one second rotary joint with an approximately horizontal axis, in the spread-out position of the pipe sections; and the arrangement further includes at least two sets of pulleys for lateral guidance of the suspension cable, the pulleys being fixed to the storage stand at different locations and movable away from the suspension cable on passage of a coupling means.

13. An arrangement according to claim 1, wherein:

the coupling means includes a number of suspension struts, to each of which is fixed a collet for gripping the suspension cable from above;

each of the collets comprises two articulated arms that are stressed towards a tightening position of the collet by a spring, each of the arms being provided with a roller; and the stand comprises two rails, each of which defines a rolling track for one of the rollers, the spacing of the rails being such that in the storage position of the pipe sections, the collet is held in an open position against the force of the spring, thereby permitting the collet to engage the suspension cable on passage of the pipe sections to the spread-out position.

14. An arrangement according to claim 13, further comprising a number of pulleys for supporting the suspension cable downstream from the rails of the storage stand.

15. An arrangement according to claim 1, further comprising a plurality of second rigid pipe sections which are connected to the pipe sections to thereby form two pipelines for the transfer of fluid simultaneously between the first and second locations.

* * * * *